US005404785A

United States Patent [19]

Belli

[11] Patent Number: 5,404,785

[45] Date of Patent: Apr. 11, 1995

[54] MUSICAL DRUM WITH MOLDED BEARING EDGE

[75] Inventor: Remo D. Belli, North Hollywood, Calif.

[73] Assignee: Remo, Inc., North Hollywood, Calif.

[21] Appl. No.: 148,965

[22] Filed: Nov. 8, 1993

[51] Int. Cl.[6] ..... G10D 13/02

[52] U.S. Cl. ..... 84/411 R

[58] Field of Search ..... 84/411 R, 411 A

[56] References Cited

U.S. PATENT DOCUMENTS

| | | | |
|---|---|---|---|
| 3,680,425 | 8/1972 | Morena et al. | 84/411 R |
| 3,911,779 | 10/1975 | Della-Porta | 84/411 R |
| 4,993,304 | 2/1991 | Lovelet | 84/411 R |
| 5,208,412 | 4/1993 | Hoshino | 84/411 R X |
| 5,301,591 | 4/1994 | Greenberg | 84/411 R |

*Primary Examiner*—M. L. Gellner

*Assistant Examiner*—Patrick J. Stanzione

*Attorney, Agent, or Firm*—Rapkin, Gitlin & Moser

[57] ABSTRACT

A musical drum which has a drum shell constructed of wood, fiber composite structures using wood, paper, (Fiberglass) glass fibers and products made therefrom, and other fibers, plastics and the like, and other materials. At least one end of the shell which is to receive a drumhead has mounted and secured thereon a molded bearing edge fashioned from a resinous or some other suitable material, which preferable is substantially in the shape of an inverted "V," although several alternative shapes are disclosed. The molded bearing edge provides a considerable increase in the strength of the drum, provides desirable sound characteristics, and provides a flat, level and uniform plane with a consistent, structural integrity over which the drumhead is mounted and tensioned.

15 Claims, 1 Drawing Sheet

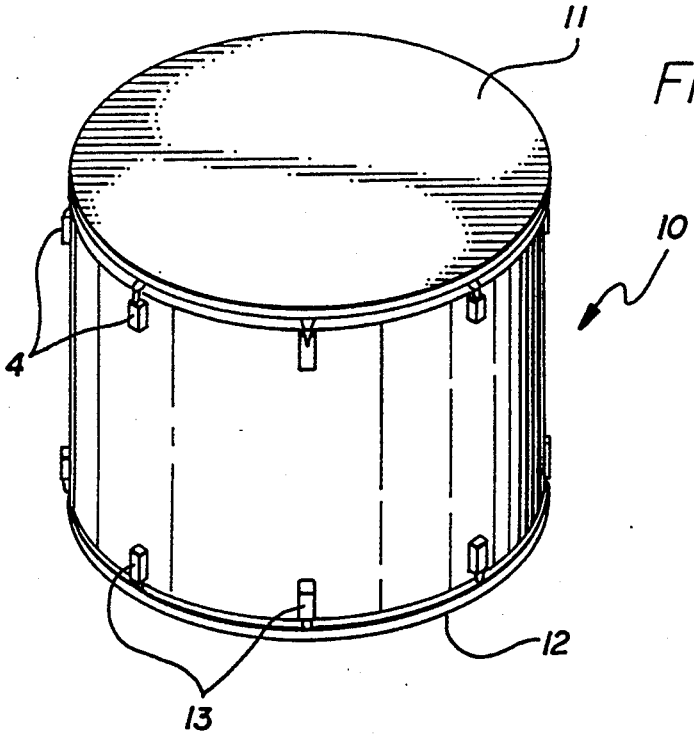
FIG. 1
FIG. 2
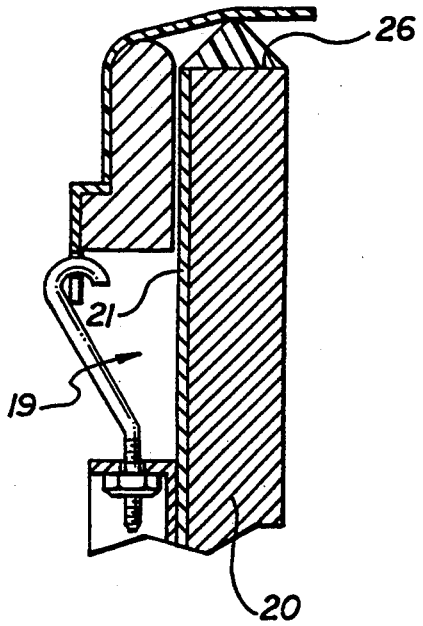
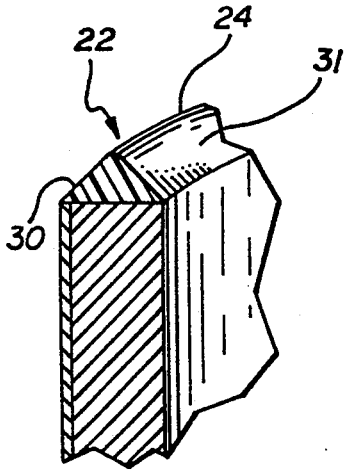
FIG. 3
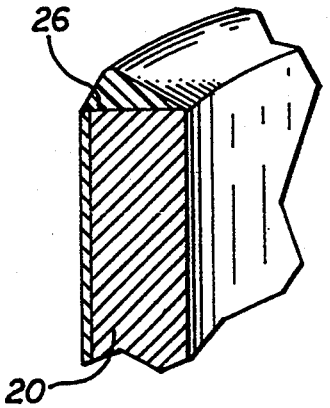
FIG. 4
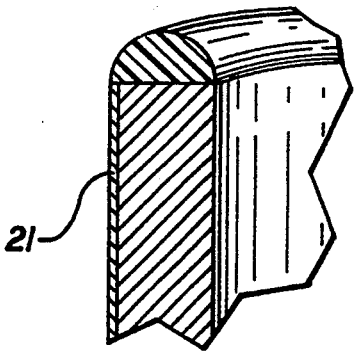
FIG. 5

MUSICAL DRUM WITH MOLDED BEARING EDGE

FIELD OF THE INVENTION

The present invention relates to musical drums, and more particularly to a drum construction using a bearing edge comprising an edge made of a resin material provided on one or both ends of a drum shell.

BACKGROUND OF THE INVENTION

The construction of musical drums varies. A typical drum comprises a cylindrical drum shell and a drumhead mounted over one or both ends. Latches or some other suitable devices are used to secure the drumhead to the end of the shell and then tension the head to the desired tonality. Drum shells have been constructed out of various materials, such as metal, wood, fiber materials and the like.

Some modern day drum shells employ a composite construction including a shell formed of a pressed or laminated fibrous material to provide the basic rigidity and sound qualities, and which has a suitable outer coating provided for appearance.

Drum shells made of various wood and composite materials, such as fiber or (Fiberglass) glass fibers and products made there from, tend to collapse at or along the edge of the shell over which the drumhead is mounted and stretched. The collapse of the edge usually occurs as a result of the concentrated stress buildup in that area brought about by the tensioning process and the constant pounding of the drumsticks on the drumhead surface. The collapsed edge usually appears cracked and buckled. In some cases, the fiber laminations will begin to separate and, thus, cause a further weakening of the edge. When this occurs, the sound qualities of the instrument begin to suffer dramatically.

To resolve these problems, attempts have been made to add a cylindrical ring inside the shell at or near the top to provide rigidity to the end of the shell. Shells of greater thickness can be used also, but the increased thickness adds substantially to the weight of the shell and, consequently, the weight of the drum, making it difficult for some drummers (e.g., youngsters) to carry the drum in parades and the like. Other such efforts include the use of a metal bearing edge which conforms to the shape of one or both ends of a drum shell. However, metal is a relatively heavy material and adds to the weight of the instrument making it more difficult, for example, to carry and play the drum in a marching band. Metal bearing edges also required the use of screws or nails or some similar device to properly secure the metal to the drum shell. Thus, the process in utilizing a metal bearing edge can become extremely labor intensive adding substantially to the cost of manufacturing the instrument.

The deterioration of drum shell edges made from wood and fibrous materials, as previously described, are not the only drawbacks associated with these materials. Edges fabricated from these substances require a significant amount of routing, sanding and shaping to achieve the kind of edge that is capable of effectively supporting the drumhead and assisting in producing the most desirable tonal qualities for the instrument. As with the metal bearing edge discussed previously, the process involved in the manufacture of a drumshell using wood or any suitable fibrous material is also extremely labor intensive.

Accordingly, there is a need in the art to provide a bearing edge that can be fabricated using a technique that is not labor intensive, that can maintain its uniformity and structural integrity over time and will continuously resist the kind of deterioration that normally results from the severe stress buildup on the edge caused by the tensioning process and the constant striking of the drumhead surface.

SUMMARY OF THE INVENTION

The present invention provides a solution to the foregoing problems not addressed in the prior art and, in addition, enhances the sound produced by the drum. The present invention provides a molded resinous bearing edge or cap, preferable substantially in the shape of an inverted "V," which is secured in the context of any conventional molding process to the end of a drum shell formed of wood, fiber, (Fiberglass) glass fibers and products made therefrom, or the like, and the drumhead is suitably stretched over essentially the apex of the bearing edge. The molded resinous bearing edge strengthens the edge of the shell and eliminates the tendency of the edge to collapse upon the tightening of the drumhead. This edge also brightens the sound generated by the drum and, further, maintains the flatness of the plane or line contact with the underside of the drumhead. This invention also provides a minimal friction edge over which the drumhead can easily be tightened. Although the inverted "V" shape is preferred, almost any other shape of edge would be suitable, including a skewed shape, wherein the apex is offset to one side or another (radially in or out from the centerline of the edge), a somewhat rounded version, or even a flat plane.

Thus, the present invention results in a considerable increase in the strength of the drum and provides desirable and improved sound characteristics.

Accordingly, it is an object of the present invention to provide an improved drum construction.

Another object of the present invention is to provide an improved bearing edge for one or both ends of a drum shell formed of wood, fiber, (Fiberglass), plastic or similar materials.

A further object of the present invention is to provide an improved bearing edge preferably substantially in the shape of an inverted "V" affixed to an end of a drum shell to strengthen the end of the drum shell, and provide a lower friction edge over which a drumhead may be stretched.

A still further object of the present invention is to provide an improved bearing edge affixed to one or both ends of a drum shell that will maintain its uniformity of shape and structural integrity over time.

These and other objects and features of the present invention will become better understood through a consideration of the following description taken in conjunction with the drawing in which:

BRIEF DESCRIPTION OF THE DRAWINGS

FIG. 1 is a perspective view of a conventional drum incorporating the concepts of the present invention.

FIG. 2 is a cross-sectional view of a drum shell before the molded bearing edge is secured according to the present invention.

FIG. 3 is a cross-sectional view of an end of a drum shell with a molded bearing edge formed in an inverted substantially "V" shape secured to the end of the shell according to the present invention.

FIG. 4 is a cross-sectional view similar to FIG. 3, but with the molded bearing edge formed in an inverted substantially "V" shape with the apex offset to one side secured to the end of the drum shell according to the present invention.

FIG. 5 is a cross-sectional view similar to FIG. 3, but with the molded bearing edge formed rounded along the top surface secured to the end of the drum shell according to the present invention.

DETAILED DESCRIPTION OF THE PREFERRED EMBODIMENT

FIG. 1 shows a drum shell 10 of conventional cylindrical form having an upper drumhead 11 and a lower drumhead 12 attached to the drum shell 10 by several sets of conventional latches 13 and 14. U.S. Pat. No. 3,647,931 illustrates one form of an exemplary drum of the prior art.

Drum shells are made from various materials including metal, wood, fiber material molded or layed up in a composite construction, including wood fibers, paper and/or (Fiberglass) fibers, plastic and the like. The present invention is directed to drums having drum shells of non-metallic construction and will be referred to herein and in the claims for convenience as "fiber"0 drum shells or drum shells of "fiber" construction to encompass wood, plastic, fibrous and other various non-metallic drum shells. Under the appropriate circumstances, however, the present invention may be employed with drum shells made of metal and a variety of other substances.

FIG. 2 illustrates in a cross-sectional view a typical composite drum shell 19 with a fiber shell 20 having a plastic outer cover 21. The shell 20 is conventional, and is formed from wood fiber in the form of a fiber tube. A typical construction uses fibrous paper material pressed together to comprise a laminate containing multiple revolutions and with a wall thickness of approximately three-sixteenths inch. The plastic outer layer 21 can be any suitable thickness and color, and is primarily employed for appearance and to protect the outer surface of the shell 20. The layer 21 preferably covers substantially the entire outer surface of the shell 21.

When the drumhead is tightened across the end of a conventional fiber shell 20, it frequently is necessary to substantially stretch the head, using any conventional tensioning mechanism. When this is done it is common over time for the edge of the shell to deteriorate, buckle and eventually collapse. Edge deterioration will accelerate as a result of the constant pounding of the drumstick on the drumhead surface. With drum shells produced in accordance with prior art methods, an inverted "V" configuration (not shown) has been provided at the end of wood shells to minimize the friction of the shell edge on the drumhead. However, the thin apex of the edge, because of its relative fragility, contributes even more to the shell's edge collapse. Certain fiber shells, due to this deterioration problem, soon begin to produce dull or offensive overtones, which detract from the overall sound quality of the instrument.

FIG. 3 illustrates a preferred form of a molded resinous bearing edge 22 according to the present invention. This molded resinous bearing edge 22 has an inverted "V" configuration, extending downwardly from the apex into a pari of skirts 30 and 31. Configuration of the edge 22 can be such that the apex 24 can be offset to one side or the other or can be rounded as shown in FIGS. 4 and 5, or even somewhat flat (not shown), if desired. The bearing edge 22 is secured to the end 26 of the fiber shell 20 by way of the natural bonding that occurs between the outer surface of the end 26 and the underside of the bearing edge 22 during the molding process. Adhesives (not shown), such as epoxy applied between the underside of the bearing edge 22 and the outer surface of the end 26, or some other suitable means of securing the bearing edge 22 to the shell 20, are usually unnecessary. The bonding between the bearing edge 22 and the outer surface of the end 26 is enhanced even further due to the constant downward pressure exerted upon the edge 22 onto the end 26 by virtue of the tightening of the drumhead by the tensioning mechanism. The other end (not shown) of the shell 20 as seen in FIG. 2 may have a similar construction and a molded resinous bearing edge 22 thereon.

While any suitable resin material can be used to form the molded resinous bearing edge 22, it has been found that the chemical compounds polyurethane or polyurea using any conventional injection molding process to form the edge 22 to the shapes shown in FIGS. 3 through 5 is suitable. Molded resinous bearing edge 22 extends completely around the end 26 of the shell 20 to cover the entire end 26 and to provide a continuous circular, substantially line contact, by the apex 24 of the bearing edge 22. This results in a flat plane or circular line contact with the underside of the drumhead and thereby maintains a flatness of the edge to head contact.

Accordingly, the primary concepts of the present invention are the use of a molded resinous bearing edge, preferably of an inverted substantially "V" cross-sectional configuration, on a fiber drum shell. It has been found that this construction provides a significant gain in strength to the bearing edge allowing the drumhead to be tensioned around a standard thickness fiber shell without the usual risk and eventuality of a premature edge failure. The bearing edge 22 fashioned in accordance with the present invention is precluded from deteriorating and eventual total collapse while also providing the instrument with a brighter or sharper sound.

Mechanically, the addition of the molded resinous bearing edge 22 reinforces the end 26 of the shell 20 both diametrically and axially. The plane of the bearing edge at the apex 24 is maintained flat and the concentricity of the shell is maintained round because of the shape and persistent integrity of the bearing edge 22. The apex 24 provides essentially a single circular line contact point for the underside of the drumhead. The resulting drum will yield more varied and reliable frequencies and the resultant sound will be considered acoustically more acceptable.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A musical drum comprising:

a substantially cylindrical one-piece drum shell having at least one end over which a drumhead is to be attached, and a bearing edge comprised of a resinous material devoid, of Fiberglass said bearing edge secured to said end substantially continuously around said end, and having an external configuration of a form substantially providing an apex adapted to contact and support a drumhead.

2. A drum as in claim 1 wherein said end of said shell is substantially flat and said bearing edge is formed in an inverted substantially "V" shape, and said bearing edge is formed in a mold and shaped therein in contact relation with said shell.

3. A drum as in claim 1 wherein said resinous material is comprised of polyurethane.

4. A drum as in claim 1 wherein said resinous material is comprised of polyurea.

5. A drum as in claim 1 wherein said drum shell is of a fiber construction.

6. A musical drum comprising:

a substantially cylindrical one-piece drum shell of fiber construction having at least one end over which a drumhead is to be attached, and a bearing edge comprised of material devoid of Fiberglass formed in a mold, said bearing edge secured to said end substantially continuously around said end, and having an external configuration in the form of an inverted substantially "V" shape wherein the apex of the "V" is adapted to contact and support a drumhead.

7. A musical drum comprising:

a substantially cylindrical one-piece drum shell of fiber construction having at least one end over which a drumhead is to be attached, a bearing edge comprised of a molded resinous material devoid of Fiberglass secured to said end substantially continuously around said end, said bearing edge having an external configuration in the form of an inverted substantially "V" shape having an apex, and a drumhead stretched over said apex of said bearing edge.

8. A drum as in claim 7 wherein said end of said shell is substantially flat in shape, and said bearing edge is mounted continuously around said end of said shell and secured thereto.

9. A musical drum comprising:

a substantially cylindrical one-piece drum shell of fiber construction having at least one end over which a drumhead is to be attached, said end having a substantially flat shape, a bearing edge, comprised of a molded resinous material devoid of Fiberglass secured to said end continuously around said end, said bearing edge having a configuration in the form of an inverted substantially "V" shape at one end and a substantially flat surface at the other end, said end with said flat surface being closely mounted on and mated with said end of said shell and being secured thereto whereby said apex forms a support and contact circle for a drumhead, and a drumhead stretched over said apex of said bearing edge and secured to said drum shell.

10. A musical drum comprising:

a substantially cylindrical one-piece drum shell of fiber construction having at least one end over which a drumhead is to be attached, a bearing edge comprised of a molded resinous material devoid of Fiberglass secured to said end substantially continuously around said end, said bearing edge having an external generally flat configuration, and a drumhead stretched over said bearing edge.

11. A musical drum comprising:

a substantially cylindrical one-piece drum shell of fiber construction having at least one end over which a drumhead is to be attached, a bearing edge comprised of a molded resinous material devoid of Fiberglass secured to said end substantially continuously around said end, said bearing edge having an external generally rounded configuration, and a drumhead stretched over said bearing edge.

12. A musical drum comprising:

a substantially cylindrical one-piece drum shell having at least one end over which a drumhead is to be attached, and a molded bearing edge comprised of material devoid of Fiberglass secured as a separate piece to said end substantially continuously around said end, and having an external configuration of a form substantially providing an apex adapted to contact and support a drumhead.

13. A musical drum comprising:

a substantially cylindrical one-piece drum shell of fiber construction having at least one end over which a drumhead is to be attached, and a bearing edge comprised of material devoid of Fiberglass formed in a mold, said bearing edge secured to said end substantially continuously around said end, and having an external configuration in the form of an inverted substantially "V" shape, including an apex, said bearing edge being skewed wherein the apex is offset to one side or another and is adapted to contact and support a drumhead.

14. A musical drum comprising:

a substantially cylindrical drum shell having at least one end over which a drumhead is to be attached, and a bearing edge comprised of polyurethane, said bearing edge secured to said end substantially continuously around said end, and having an external configuration of a form substantially providing an apex adapted to contact and support a drumhead.

15. A musical drum comprising:

a substantially cylindrical drum shell having at least one end over which a drumhead is to be attached, and a bearing edge comprised of polyurea, said bearing edge secured to said end substantially continuously around said end, and having an external configuration of a form substantially providing an apex adapted to contact and support a drumhead.

* * * * *